US006241481B1

(12) United States Patent
Keyes et al.

(10) Patent No.: US 6,241,481 B1
(45) Date of Patent: Jun. 5, 2001

(54) WATER PUMP SHAFT SEAL ASSEMBLY FOR IN-LINE WATER AND POWER STEERING PUMPS

(75) Inventors: Kevin D. Keyes, Shelby Township; Anthony C. Barr, Birmingham; Gary F. Korejwo, Canton; William A. Thomas, West Bloomfield, all of MI (US)

(73) Assignee: Chrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/150,328

(22) Filed: Sep. 9, 1998

(51) Int. Cl.[7] ..... F04B 23/14
(52) U.S. Cl. ..... 417/201
(58) Field of Search ..... 417/201; 277/424, 277/425; 385/135, 136; 415/110; 416/174

(56) References Cited

U.S. PATENT DOCUMENTS

| | | | | |
|---|---|---|---|---|
| Re. 34,319 | * | 7/1993 | Boutin et al. | 415/174.2 |
| 3,693,985 | * | 9/1972 | Dillner | 277/29 |
| 3,822,066 | * | 7/1974 | Keys | 277/96 |
| 4,114,586 | | 9/1978 | Fujikawa et al. . | |
| 4,147,468 | * | 4/1979 | Murakami et al. | 415/213 R |
| 4,203,710 | | 5/1980 | Farr . | |
| 4,412,515 | | 11/1983 | Fritzenwenger . | |
| 4,436,067 | | 3/1984 | Fritzenwenger . | |
| 4,486,668 | | 12/1984 | Asahi et al. . | |
| 4,715,780 | * | 12/1987 | Kan | 415/200 |
| 5,151,010 | | 9/1992 | Vesala et al. . | |
| 5,195,479 | | 3/1993 | Jasetpj et al. . | |
| 5,282,446 | | 2/1994 | Whitfield . | |
| 5,558,343 | * | 9/1996 | Aparicio, Jr. | 277/88 |
| 5,730,633 | * | 3/1998 | Henmi et al. | 440/112 |
| 5,785,491 | * | 7/1998 | Ozawa et al. | 415/70 |
| 5,797,602 | * | 8/1998 | Less | 277/372 |
| 5,947,479 | * | 9/1999 | Ostrowski | 277/306 |

FOREIGN PATENT DOCUMENTS 3409605 9/1985 (DE) .

* cited by examiner

*Primary Examiner*—Teresa Walberg
*Assistant Examiner*—Daniel Robinson
(74) *Attorney, Agent, or Firm*—Kenneth H. Maclean

(57) ABSTRACT

An in-line combination steering pump with a shaft and water pump having a housing defining a pumping chamber into which the outer end of the shaft extends. The water pump housing supports an annular adapter member for supporting a seal which encompasses the shaft and is press mounted in the adapter. An impeller is removably secured to the outer end of the shaft adjacent the seal. A bushing encompasses the shaft between the seal and the impeller and is compressed by attachment of the impeller to the shaft so as press the seal firmly into the adapter. For replacement, the seal and bushing are removable over the outer end of the shaft after the impeller is removed.

3 Claims, 2 Drawing Sheets

WATER PUMP SHAFT SEAL ASSEMBLY FOR IN-LINE WATER AND POWER STEERING PUMPS

This invention relates generally to shaft seals and more particularly to a water pump shaft seal for an in-line water pump and power steering pump assembly.

BACKGROUND AND SUMMARY OF THE INVENTION

Water pump failure usually occurs as a result of leakage of a shaft seal. When such leakage develops, the typical solution is to replace the entire water pump.

However, when the water pump is combined with the power steering pump of a motor vehicle, replacement of the combined unit becomes prohibitively expensive. What is needed is a seal assembly which can be easily serviced and replaced without requiring the entire water pump and power steering pump assembly to be replaced.

In accordance with the present invention, a water pump has an impeller removably secured to the outer end of a shaft. A seal in the water pump housing surrounds the shaft. The seal is axially removable over the outer end of the shaft after the impeller is removed.

Preferably the seal is pressed into an annular adapter in the housing. A bushing between the seal and the impeller is compressed by axial movement of the impeller as it is attached to the end of the shaft. Specifically, the fastener attaching the impeller to the shaft exerts an axial force against the impeller and then against the seal. This presses the seal more firmly into the adapter. The bushing, moreover, serves as a protective sleeve to prevent corrosion of the shaft surface. Shaft surface corrosion is undesirable because it may prevent the replacement seal from forming a water-tight seal around the shaft.

The seal arrangement of this invention is preferably employed in an in-line water pump and power steering pump assembly wherein the shaft which pumps power steering fluid is the same shaft to which the water pump impeller is secured.

One object of this invention is to provide a shaft seal for a water pump and power steering pump assembly having the foregoing features and capabilities.

Another object is to provide a shaft seal for a water pump and power steering pump assembly which is composed of a relatively few simple parts, is capable of being readily replaced without requiring replacement of the entire pump assembly, and which is relatively inexpensive to manufacture and assemble.

These and other objects, features and advantages of the invention will become more apparent as the following description proceeds, especially when considered with the accompanying drawings.

DETAILED DESCRIPTION OF THE PREFERRED EMBODIMENT

Figure 1:
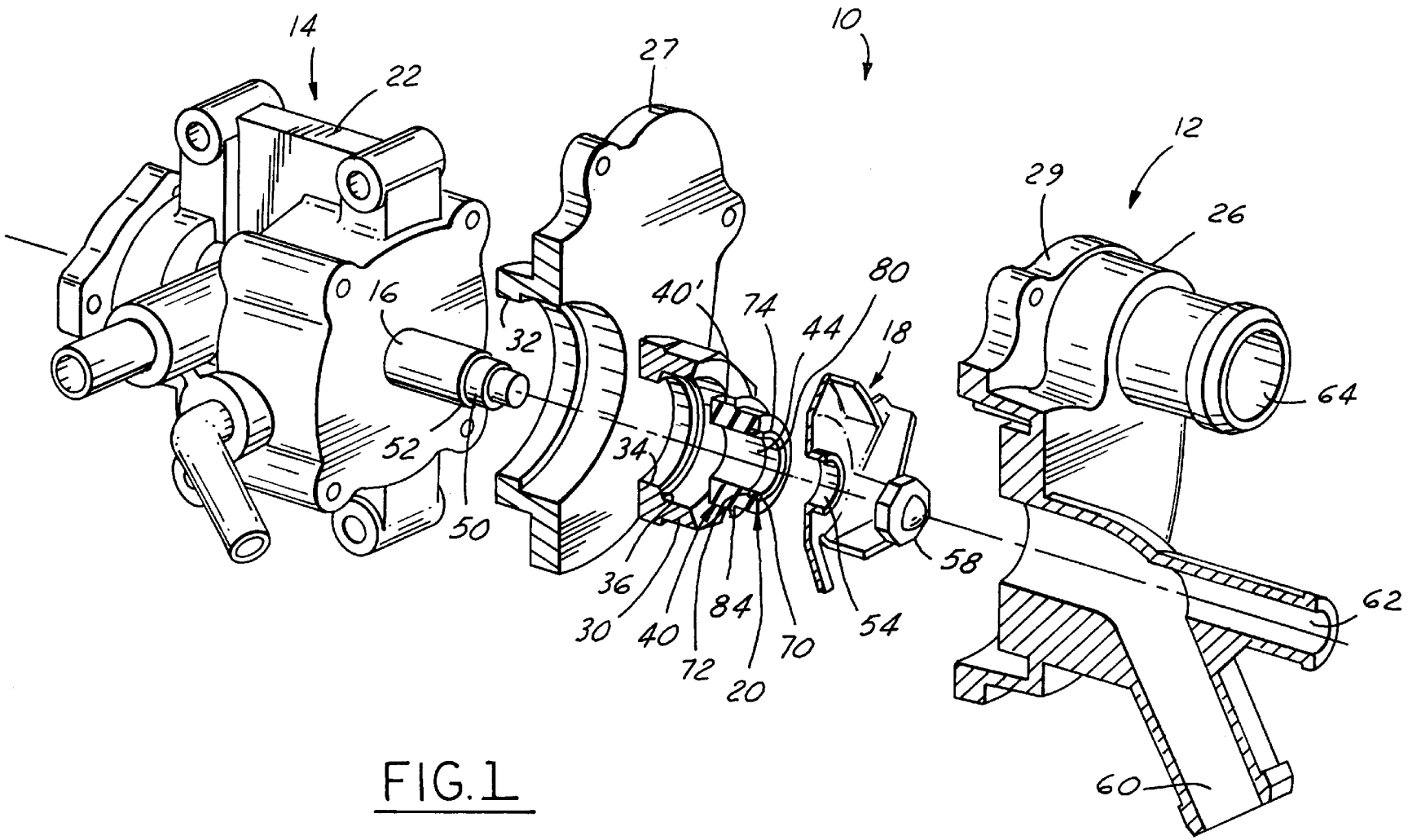
FIG. 1 is an exploded perspective view, with parts in section, of an in-line water pump and power steering pump assembly having a shaft seal, all constructed in accordance with the invention.

Referring now more particularly to the drawings, there is shown an in-line water pump and power steering pump assembly 10 including a water pump portion 12 and a power steering pump portionl4. The power steering pump has a rotatable shaft 16, which also serves as the shaft for driving a bladed impeller 18 of the water pump. An annular seal assembly 20 surrounds shaft 16.

Figure 2:
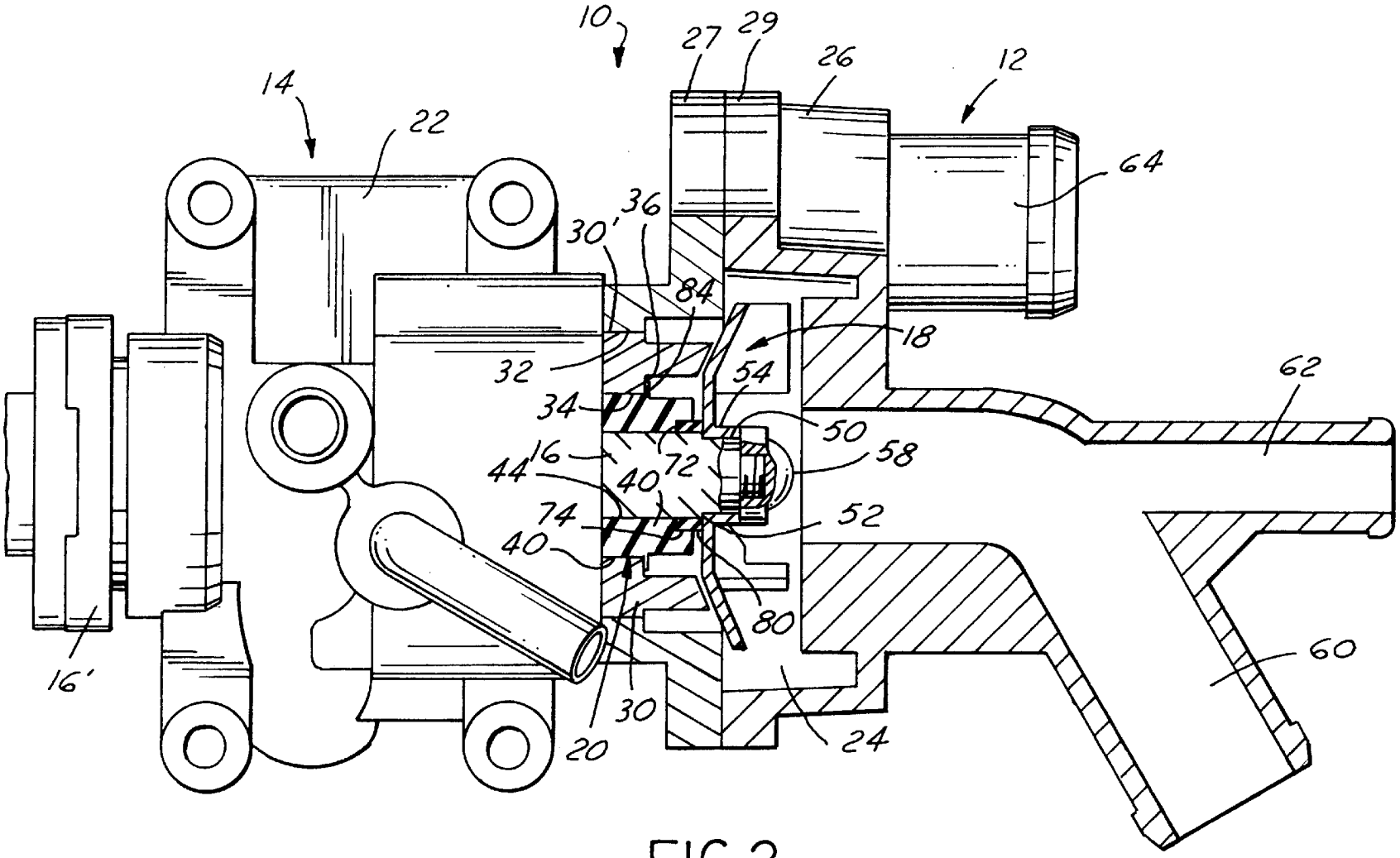
FIG. 2 is a side elevational view, with parts in section, of the assembly shown in FIG. 1.

The power steering pump 14 has a pump housing 22 in which the shaft 16 is supported for rotation. The shaft 16 receives rotational input at end 16' from a rotational engine source and is operationally connected to pump means within housing 22 for pressurizing and circulating power steering fluid in a conventional manner. As best understood by reference to FIG. 2, shaft 16 projects from the end of power steering pump housing 22 and into a pumping chamber 24 defined within a water pump enclosure 26 which includes housing members 27 and 29. The power steering pump housing 22 and the water pump enclosure 26 are mated in end to end relationship and secured together by suitable means such as fasteners as is conventional in pump construction.

The water pump enclosure 26 includes a pair of separable housing plates 27 and 29. Housings 27 and 29 are removably secured to one another by fasteners, preferably bolts (not shown). the pumping chamber 24 is defined within the housings 27 and 29.

An annular shaft seal adapter member 30 is positioned adjacent the inner (leftward) end portion of housing member 27. Specifically, an outer cylindrical surface 30' of the adapter 30 is secured within an annular radially inner wall 32 of the housing member 27 by a threaded fastening or by press fit. Adapter 30 also has a radially inner cylindrical surface 34 and a radially outwardly projecting shoulder surface 36 for a purpose to be explained hereinafter.

The outer (rightward) end portion of shaft 16 extends through the annularly configured seal assembly 20 and into the pumping chamber 24 of the water pump 12. Seal assembly 20 includes a seal annulus 40 which has a cylindrical outer surface 40' adapted to be pressed into the previously identified inner surface 34 of adapter 30. The seal annulus 40 also has an inner cylindrical surface 44 adapted to encompass shaft 16 in a water tight relationship. The outer (rightward) end of shaft 16 has a reduced diameter portion 50 which defines a radial shoulder 52. The water pump impeller 18 includes a central hub 54 sized and configured to slip fit onto the reduced diameter end portion 50 of shaft 16. The axial location of the hub 54 is established by engagement with shoulder 52. Impeller 18 is secured to shaft 16 by a removable fastener, preferably in the form of a crown nut 58. The impeller is rotated by shaft 16 to cause engine coolant to circulate from inlet passages 60, 62 connected to a radiator outlet and to a heater outlet respectively. The coolant is discharged from the water pump 12 through an outlet passage 64.

The seal annulus 40 has a recess formed at its outer (rightward) end including a radially extending shoulder 72 and a cylindrical wall 74 extending from the radial wall or shoulder 72 to the outer end of the member 40. The recess houses a cylindrical bushing 80 of rubber or like flexible, compressible material about shaft 16. The inner (leftward) end portion of the bushing 80 is axially located by the radial wall or shoulder 72. Preferably, the axial length dimension of bushing 80 in its natural uncompressed condition is greater than the distance between the impeller hub 54 and the radial wall 72 of the recess so that when the impeller 18 is secured to the shaft 16 up against the shoulder 52, the impeller compresses the bushing to exert an axially directed force against the seal 40 and presses the seal more firmly into the adapter.

The seal 40 has an integral radially outwardly extending flange 84 which engages radial surface 36 of the adapter member 30 to oppose the force exerted against the seal by the bushing 80. The seal is held from leftward axial movement by the flange 84.

When it is desired to replace the seal assembly 20, the water pump housings 27 and 29 are disconnected and the rightward housing 29 is separated to gain access to the water pump chamber 24. The crown fastener 58 is removed so that impeller 18 can be taken off of the end of the shaft 16. Next, the seal assembly 20 including members 30 and 80 are readily slipped off the end of the shaft 16. A new seal and bushing may be substituted, the impeller re-attached to the end of the shaft and the housing reassembled.

What is claimed is:

1. A water pump comprising:

a pump housing having a first housing part and a second housing part removably secured to said first housing part, said housing parts cooperating with one another to define a pump chamber, a rotatable shaft having an outer end extending into said chamber, an annular seal mounted in said housing and encompassing said shaft adjacent to the outer end thereof in water-tight sealed relation therewith, an impeller, and means removably securing said impeller to the outer end of said shaft, said second housing part being separable from said first housing part to permit access to said seal, and said seal being axially removable over the outer end of said shaft when said impeller is removed and said second housing part is separated from said first housing part, further including an annular adapter secured to said first housing part, said seal being pressed into said adapter, and a bushing sleeved on said shaft between said seal and said impeller and compressed by said impeller to exert an axially directed force against said seal to press said seal more firmly into the adapter.

2. A water pump according to claim 1, further including an integral radially outwardly extending flange on said seal engaging a radial surface of said adapter to oppose the force exerted by the seal against said bushing.

3. A water pump according to claim 2, wherein said seal has a radiallly inner surface engaging said shaft and an outer end surface adjacent said impeller, a recess in said radially inner surface defined by an annular radial wall spaced from said outer end surface of said seal and a cylindrical wall extending form said radial wall to the outer end surface of said seal, said bushing being disposed in said recess and compressd between the radial wall of the recess and said impeller to exert said axially directed force against said seal to press said seal more firmly into said adapter.

* * * * *